United States Patent [19]

Sukolics

[11] 4,187,657

[45] Feb. 12, 1980

[54] THERMAL WINDOWS

[75] Inventor: Ronald D. Sukolics, Creve Coeur, Mo.

[73] Assignee: Swiss Aluminium Ltd., Chippis, Switzerland

[21] Appl. No.: 921,818

[22] Filed: Jul. 3, 1978

[51] Int. Cl.[2] ..... E06B 3/00

[52] U.S. Cl. ..... 52/397; 52/769; 49/DIG. 1; 52/488; 52/403

[58] Field of Search ..... 52/762–763, 52/769, 403, 397, 488, 770–773; 49/401, 408, DIG. 1, 383, 398

[56] References Cited

U.S. PATENT DOCUMENTS

| | | | |
|---|---|---|---|
| 2,321,237 | 6/1943 | Peterson | 52/769 |
| 2,877,515 | 3/1959 | Haas | 52/172 |
| 3,212,225 | 10/1965 | Neal | 52/769 |
| 3,242,627 | 3/1966 | Fountain | 52/769 |
| 3,308,582 | 3/1967 | Bakke | 49/383 |
| 3,555,735 | 6/1971 | Weikert | 52/403 |

FOREIGN PATENT DOCUMENTS

| | | | |
|---|---|---|---|
| 2288845 | 5/1976 | France | 49/401 |
| 1295535 | 11/1972 | United Kingdom | 49/408 |

*Primary Examiner*—James L. Ridgill, Jr.
*Attorney, Agent, or Firm*—Bachman and LaPointe

[57] ABSTRACT

An improved design for both fixed and operating type windows is disclosed in which the window is thermally broken without the use of an insulating material as a thermal break. The improved windows of the present invention are designed so as to enable both fixed and operating types to be secured to the same frame member thus allowing for easy and architecturally pleasing unit stacking.

45 Claims, 8 Drawing Figures

THERMAL WINDOWS

BACKGROUND OF THE INVENTION

The present invention relates to an improved thermal window design for both fixed and operating type windows and more specifically is drawn to an improved design which allows for the unit stacking of fixed and operating type windows within the same frame member.

In recent years it has become highly desirable to use light metallic structural materials such as aluminum for the frame members in both fixed and operating type windows. The major disadvantage of using highly thermal conductive materials for the frame and vent members of thermal windows is that heat is transferred between the interior and exterior parts of the window which results in the formation of condensation on the warm side of the window as well as heat loss therefrom.

In order to eliminate the heat lost between the interior and exterior portions of a metal window frame in fixed type windows it has become commonplace in the art to form a thermal break between the exterior and interior frame portions. A typical thermal break is taught in U.S. Pat. No. 2,877,515 wherein a thermal break is accomplished by providing separate framing members for the exterior and interior and connecting the members by introducing a barrier of non-metallic insulating material therebetween. While the arrangement disclosed in the aforenoted U.S. patent provides a sufficient thermal barrier in fixed type windows, there are substantial disadvantages associated with such a design. The need for providing an insulating member between the frame member greatly increases the cost of manufacturing the window. In addition, the window frame is inherently weakened. Furthermore, the integrity of the longevity of the insulating material as a connecting member is questionable. Naturally, it would be highly desirable to provide a thermally broken window without the need of an insulating member as previously discussed.

U.S. Pat. No. 3,308,582 to Bakke and German Offenlegungsschrift No. 2,300,358 both disclose operating type thermal windows in which a thermal barrier is established between the frame and vent members. However, in both the Bakke and the German patent the frame and vent members are in indirect contact via a thermal insulating member. In addition to the above, the window disclosed in the Bakke patent requires that the vent be disassembled in order to install the glass.

Aside from the aforenoted disadvantages exhibited by the prior art with regard to insulating, a further and still more important disadvantage of thermal window designs heretofore known is the inability to provide a single window frame which is capable of accepting both fixed glass face members and operating vent members thereby allowing for easy unit stacking of fixed and operating windows. Heretofore, in order to stack fixed and operating thermal windows it was necessary to provide separate frame members of different size and configuration for both the fixed and operating type windows which results in a number of inherent disadvantages. In order to achieve uniform sight lines, which is highly desirable from an architectural standpoint, additional framing members were required resulting in an increase in cost and an increase in the size of the sight lines.

Accordingly, it is a principal object of the present invention to provide an improved thermal window of both the fixed and operating type which is designed to be thermally broken without the need of an insulating material as a thermal break.

It is a particular object of the present invention to provide an improved thermal window design in which both fixed and operating type windows are easily unit stacked on the same frame member.

It is a further object of the present invention to provide an improved operating type thermal window which is easily assembled.

It is still a further object of the present invention to provide an efficient thermal window which is inexpensive to manufacture.

It is a further particular object of the present invention to provide an improved thermal window design which is architecturally pleasing.

Further objects and advantages of the present invention will be evident from what appears hereinbelow.

SUMMARY OF THE INVENTION

In accordance with the present invention the foregoing objects and advantages are readily attained.

The present invention comprises an improved window design for both fixed and operating type thermal windows in which the window is thermally broken without the use of an insulating material as the thermal break. In addition, the improved window design of the present invention allows for the use of a single frame member for both fixed and operating type windows thereby enabling easy, economic and architecturally pleasing unit stacking. The thermal windows of the present invention are easily assembled and the insulating glass readily replaceable.

BRIEF DESCRIPTION OF THE DRAWINGS

The present invention will be more readily understood from a consideration of the following illustrative drawings in which.

DETAILED DESCRIPTION

Figure 1:
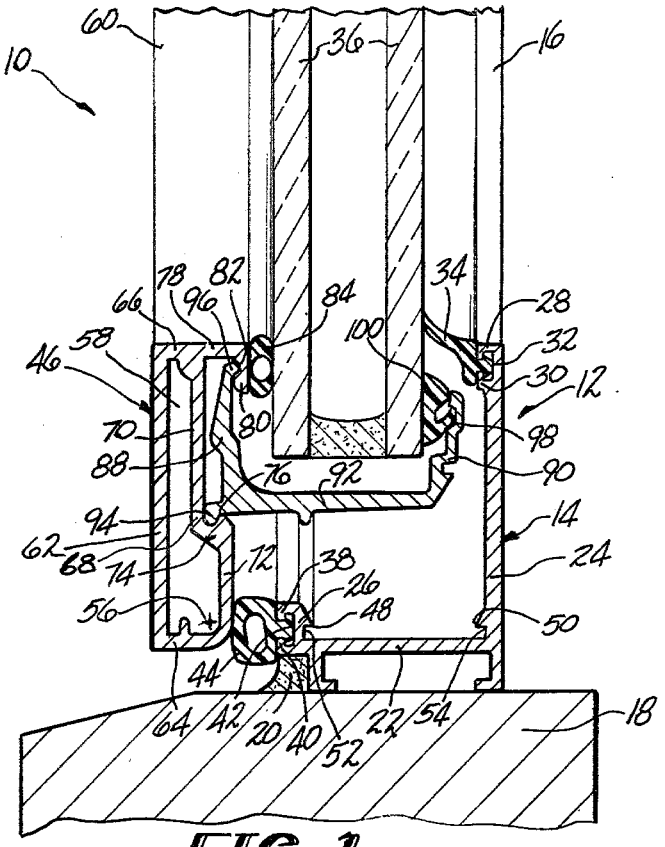
FIG. 1 is a sectional view through the frame and vent of an operating type window in accordance with the present invention wherein the vent is in the closed position.

Referring to the drawings, FIG. 1 is a sectional view through the frame and vent members of an operating type window designed in accordance with the principles of the present invention. The window is illustrated with the vent in the closed position. It should be appreciated that while the window is illustrated in FIG. 1 as a top or side hinge projected out type window, the window may be adapted to be a projected in type as well as bottom hinged or centrally hinged if desired.

Reference numeral 10 in FIG. 1 identifies an operating type window in accordance with the present invention wherein window frame member 12 consisting of two horizontal members 14 and two vertical members 16, are mounted within an opening in building wall 18 and secured thereto in any known manner, such as screws or the like, and sealed with caulking material 20. The horizontal and vertical members 14 and 16, respectively, are identical in configuration and are formed of a metal, preferably aluminum, which is extruded in one piece and subsequently cut into appropriate sizes so as to fit within the opening in building wall 18 to thereby form frame member 12. Each horizontal and vertical member of frame member 12 is of a substantially L-shaped configuration and comprises a base portion 22, a long leg portion 24 and a short leg portion 26. Long leg portion 24 at its free end is provided with a pair of flanges 28 and 30 which form therewith a channel 32 which faces toward the window glass 36 and is adapted to receive finger seal 34 which sealingly mates against window glass 36 when the window is in the closed position. Short leg portion 26 is provided at its free end with a pair of flanges 38 and 40 similar to the flanges 28 and 30 on long leg portion 24 and forms with said short leg portion a channel 42 which faces in the same direction as channel 32 on long leg portion 24. The channel 42 receives sponge neoprene seal 44 which is adapted to sealingly mate with tubular vent 46. A pair of continuous nibs 48 and 50 are formed on the inside surface of long leg portion 24 and short leg portion 26, respectively, and positioned a short distance from base portion 22 so as to form therewith a pair of continuous grooves 52 and 54.

Pivotably mounted with respect to frame member 12 and adapted to pivot around point 56 is operating tubular vent member 46 which is formed of a tubular aluminum extrusion cut into two horizontal members 58 and two vertical members 60. It is preferred that the vent member 46 is made in tubular form for added strength. Tubular vent member 46 comprises a front sight wall member 62, outer side wall member 64, inner side wall member 66 and back wall member 68. Back wall member 68 consists of two parallel portions 70 and 72, respectively, which are offset with respect to each other and connected by extension 74 which is provided with a U-shaped groove 76 which faces toward inner side wall member 66. Inner side wall member 66 is provided with an extension 78 which in turn is provided with a perpendicular flange 80 which is substantially parallel with front sight member 62 and back wall portions 70 and 72. Perpendicular flange member 80 is spaced from said front sight member 62 at a distance greater than either of the back wall portions 70 and 72 and has formed on the side thereof facing said front sight member and said back wall portions a groove 82 for purposes to be made clear hereinafter. The opposite side of perpendicular flange member 80 facing frame member 12 receives glazing tape 84 which seals against window glass 36 when the window is assembled.

A U-shaped glass holding member 86 comprises long outside leg 88 and short inside leg 90 and connecting base portion 92. Provided on the outer surface of outside leg 88 at the base thereof is a first rounded projection 94 which is adapted to be received in U-shaped groove 76 formed on extension portion 74. The outside leg 88 further includes at the top and on the inner surface thereof a second rounded projection 96 adapted to be received in groove 82 formed on flange member 80. Inside leg 90 of glass holding member 86 is provided with a channel 98 which is adapted to receive glazing wedge seal 100 when assembled. In this manner, window glass 36 is secured by glass holding member 86, when assembled, between glazing tape 84 on the outside of the window glass 36 and glazing wedge 100 on the inside of the window glass 36.

Figure 2:
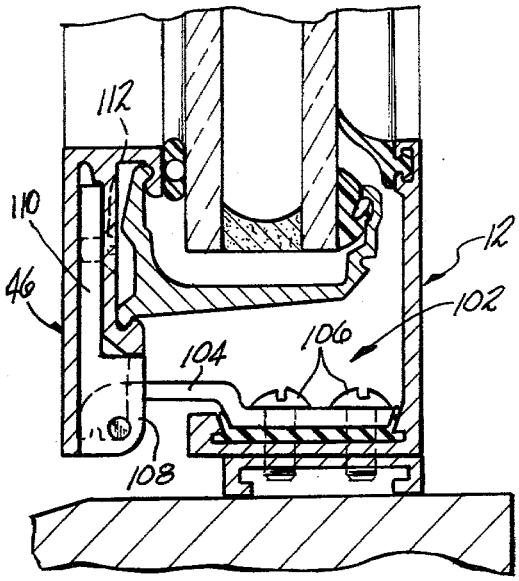
FIG. 2 illustrates a hinge mechanism used in accordance with the operating type window of the present invention.

FIG. 2 is a sectional view illustrating one mechanism for pivoting the tubular vent of the window illustrated in FIG. 1. Hinge element 102 is provided with a first member 104 which is secured to window frame 12 by screws 106. Tubular vent 46 is provided with a notched out area 108 adapted to receive second member 110 of hinge element 102 which is secured in vent 46 by screw 112. Two of the hinges illustrated in FIG. 2 are provided on opposite ends of frame 12 and secured to tubular vent 46. The window may be actuated in any suitable manner known in the art such as hand crank, push bar or the like. By hiding the pivot within the tubular vent a uniform sight line is achieved which is highly desirable from an architectural standpoint.

Figure 3A:
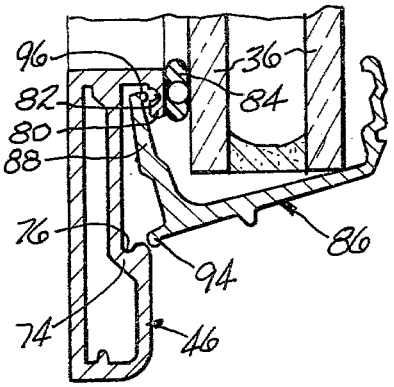
FIGS. 3A and 3B are fragmentary views illustrating the assembling of the vent and window holding members of the operating window illustrated in FIG. 1.
Figure 3B:
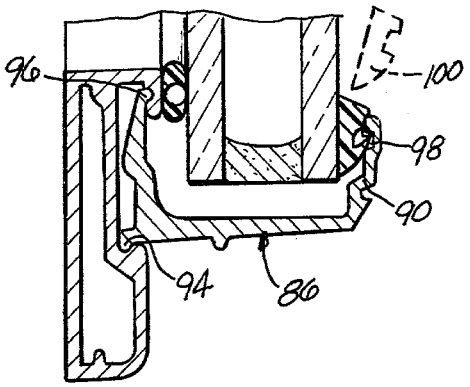

The assembly of the operating type window of the present invention will be better understood with reference to FIGS. 3A and 3B. Frame member 12 is secured within an opening in a building wall and hinge elements 102 are secured thereto. The two horizontal and two vertical members of tubular vent member 46 are assembled to form a rectangle wherein notched out areas 108 of the vent are located so as to receive second member 110 of hinge element 102 when assembled. Referring to FIGS. 3A and 3B, the opposite side of perpendicular flange member 80, provided with glazing tape 84 and window glass 36, is positioned on the glazing tape 84 on vent member 46. A first U-shaped glass holding member 86 is positioned so that second rounded projection 96 on outside leg 88 is received within groove 82 on flange member 80. The U-shaped glass holding member is then press fitted such that first rounded projection 94 is secured within groove 76 on extension 74. Glazing wedge 100 is then press fit under inside leg 90 of glass holding member 86 so as to be received in channel 98. The operation is then repeated on the other three sides of tubular vent 46 after which the tubular vent and glass assembly is pivotably secured to frame member 12 via hinge elements 102 as previously described.

Figure 4:
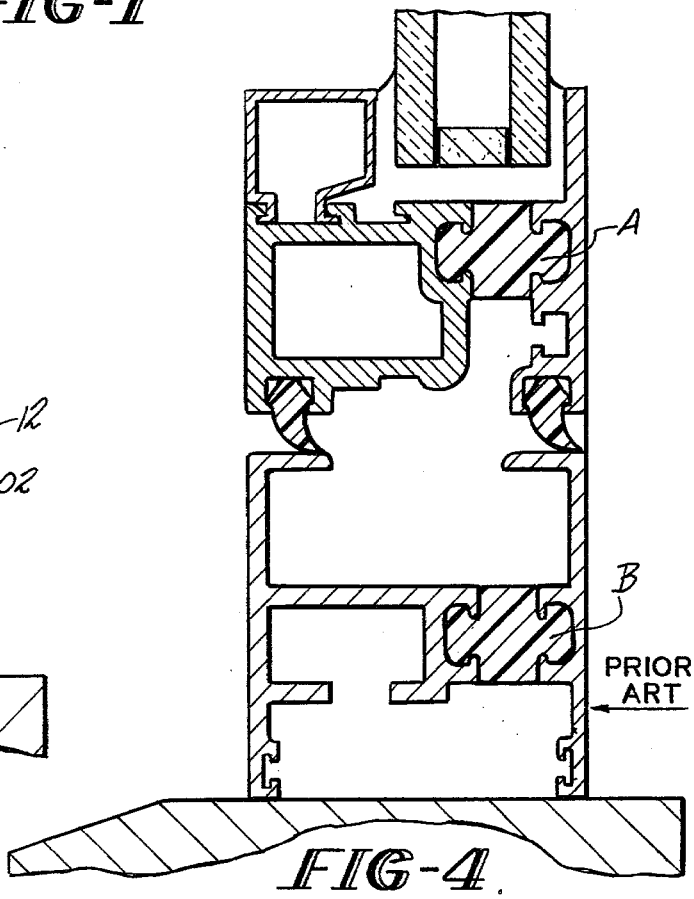
FIG. 4 is a sectional view of a typical operating type window known in the prior art.

With reference to FIGS. 1 through 3, the operating type window of the present invention offers a number of advantages over those heretofore known. The cold members, tubular vent 46 and glass holding member 86 as illustrated in FIG. 1, do not contact the warm member, frame 12 as illustrated, or warm, moist, interior air. This prevents heat loss through these members or condensation forming on these members without the use of a thermal break of insulating material as is typical in prior art thermal windows. The thermal performance of the projected window of the present invention as illustrated in FIG. 1 was compared to the thermal performance of a typical prior art projected type window, as illustrated in FIG. 4, using a thermal break material referred to as A and B. Each window was tested in accordance with *Standards and Tests of Thermal Performance of Residential Insulating Windows and Sliding Glass Doors,* published by the Architectural Aluminum Manufacturers Association. The condensation resistance performance and thermal transmittance of the window of the present invention was found to be slightly better than that of the prior art window. While the thermal performance of the windows were found to be comparable, the window of the present invention achieved an effective thermal break without the need of a thermal break of insulating material thus reducing the cost of the window, and inherently strengthening the window frame eliminating any questions as to the integrity of the longevity of the insulating material as a connecting member. A further advantage of the window design of the present invention is the ease with which the window glass can be replaced.

Figure 5:
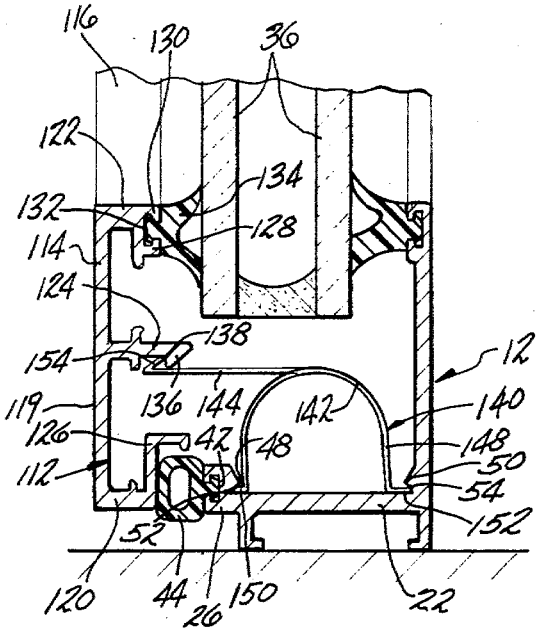
FIG. 5 is a sectional view through the frame and face member of a fixed type window in accordance with the present invention.

Referring to the drawings, FIG. 5 is a sectional view through the frame and face members of a fixed type window designed in accordance with the principles of the present invention. Frame member 12 is identical to that frame member described and used with the operating type window illustrated in FIG. 1 and thus like reference numerals are used for like parts. Fixed face member 112 is formed of an aluminum extrusion which is cut into two horizontal and two vertical members 114 and 116 respectively and then assembled to form a rectangular face member in the same manner as described for the vent member of the window illustrated in FIG. 1. Fixed face member 112 comprises front sight wall member 119, outer side wall member 120 and inner side wall member 122 extending substantially perpendicular therefrom toward the frame member 12. Intermediate wall members 120 and 122 and substantially parallel therewith is projection 124. Wall member 120, at its free end, is provided with an L-shaped extension 126 adapted to sealingly mate with seal 44 carried in channel 42 on short leg portion 26 of frame member 12 when the window is assembled. Wall member 122 is provided at its free end with a pair of flanges 128 and 130 which form therewith a channel 132 which faces toward window glass 36 and receives seal 134 which sealingly mates with window glass 36 when assembled. Projection 124 is provided on its free end with a nib 136 which forms therewith a crevice 138 adapted to receive a spring as will be explained hereinbelow.

In order to secure face member 112 to frame member 12, a plurality of springs 140 are provided which comprise a U-shaped portion 142 and a tangential extension 144 projecting from the base of the U-shaped portion 142. The upper arms, 146 and 148, respectively, of U-shaped portion 142 are provided with flanges 150 and 152 adapted to mate with continuous grooves 52 and 54 formed by nibs 48 and 50 and base portion 22 of frame member 12. Tangential extension 144 is provided with a hook type member 154 which is received in crevice 138 formed by projection 124 and nib 136. The spring may be formed of resilient materials such as stainless steel which may be coated with polyvinyl chloride or the like or alternately may be made entirely of polyvinyl chloride.

The fixed window of the present invention is assembled in the following manner. Frame member 12 is secured within an opening in building wall 18 in the same manner as previously described with reference to FIG. 1. The horizontal and vertical members of fixed face member 112 are assembled to form a rectangular configuration. A plurality of springs 140 are positioned such that flanges 150 and 152 engage grooves 52 and 54 on both horizontal and vertical members, 14 and 16 respectively, of frame member 12. Typically the springs will be one inch in width and will be located 12 to 18 inches apart. The window glass 36 is then located within frame 12 and assembled face member 112 is then positioned in place and pressed inward against window glass 36 and seal 44 such that hook member 154 is received in crevice 138 thus securing the face member 112 in place.

The fixed type thermal window of the present invention as illustrated in FIG. 5 overcomes the same disadvantages as previously described with regard to the operating window of FIG. 1. A thermal barrier is achieved in the window of the present invention due to the fact the cold member 112 does not contact warm member 12 thereby preventing loss of heat and condensation. The fixed window of the present invention achieves a thermal break and eliminates those disadvantages inherent in typical prior art constructions as typified in previously aforenoted U.S. Pat. No. 2,877,515. These advantages being reduced cost of manufacturing, inherently stronger frame, and readily assembled and replaceable window glass.

Aside from the aforenoted advantages, a principal advantage of the window design of the present invention is the provision of a single frame member which is capable of receiving both the fixed glass face member and the operating tubular vent member of the windows of the present invention thus allowing for easy unit stacking of the windows which heretofore could not be accomplished.

Figure 6:
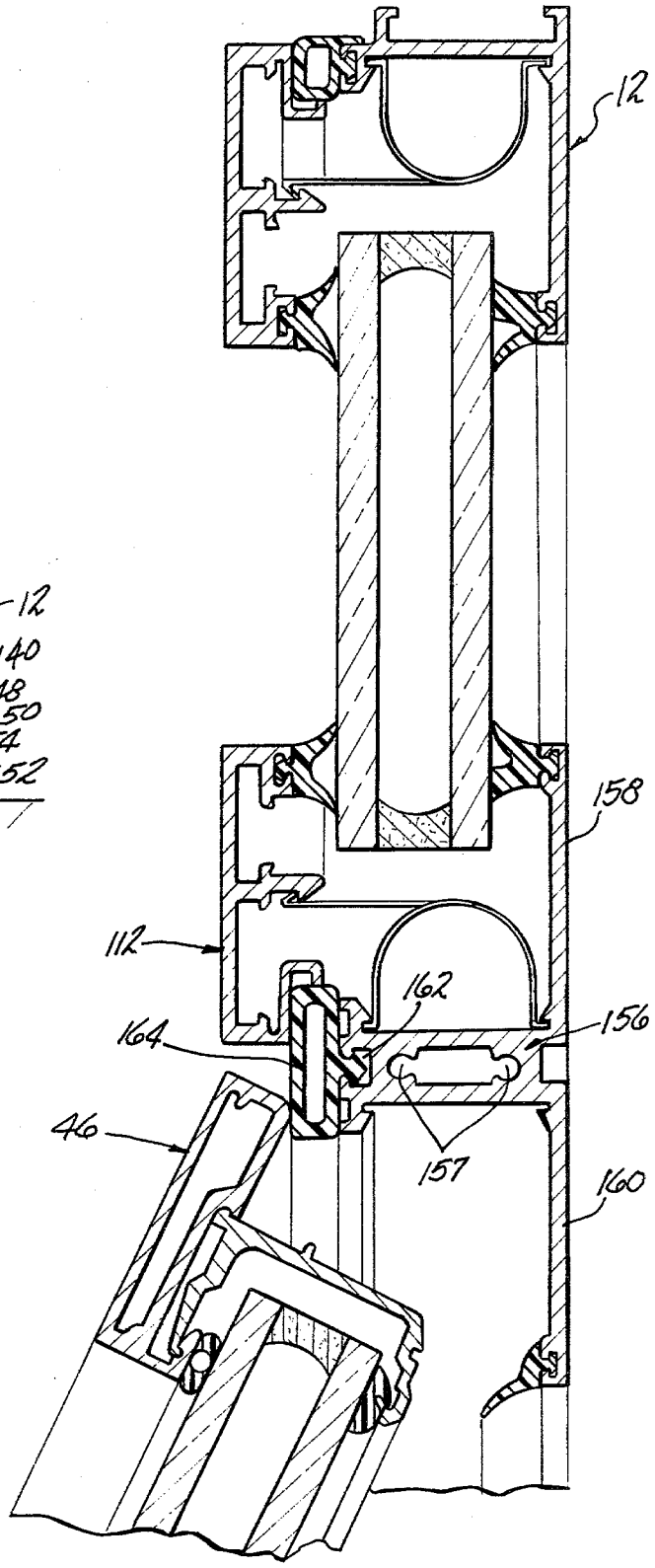
FIG. 6 is a sectional view of a stacked unit of the fixed and operating type windows illustrated in FIGS. 1 and 5.

FIG. 6 is a sectional view of a stacked unit of fixed over projected windows which illustrates the principles of the present invention. In accordance with the present invention, two horizontal and vertical members are cut to appropriate lengths and assembled so as to form frame member 12. The size of the frame member is such as to accept both fixed and operating windows in stacked relationship. With frame member 12 assembled, transition member 156 is positioned within the frame member at the appropriate height and secured thereto with screws, not shown, which are secured in screw holes 157 of transition member 156. The frame 12 is then secured within an opening in a building as previously described. Transition member 156, like the other framing members, is in the form of an extruded aluminum piece. The transition member 156 comprises back to back L-shaped members, 158 and 160, respectively, which are identical in configuration to frame member 12 and together form a channel 162 to receive seal 164 which seals against tubular vent member 46 and fixed face member 112 in the same manner as previously described for seal 44. The fixed and operating windows of the present invention may be assembled in frame member 12 and transition member 156 as described above.

The design of the present invention enables the unit stacking of fixed and operating type windows in any combination desired and furthermore readily allows for the substitution of one type window for the other without the need for changing frames. The window design in accordance with the present invention achieves uniform narrow sight lines due in part to the fact that the pivot of the operating window is hidden within the tubular vent. Narrow and uniform sight lines are highly desirable from an architectural standpoint.

Figure 7:
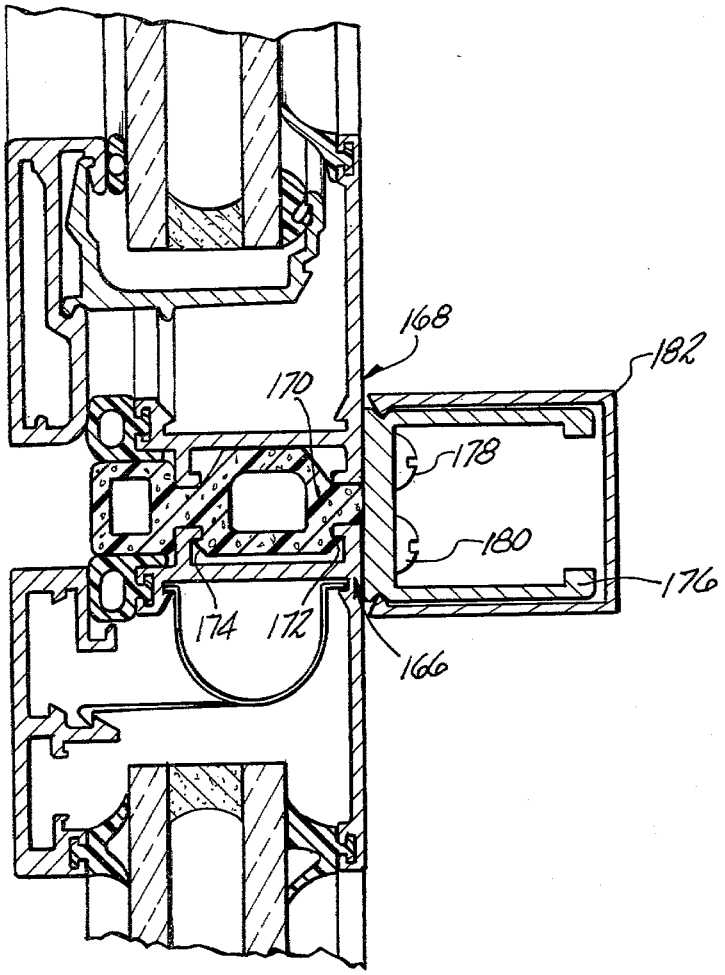
FIG. 7 is a sectional view through an alternate stacking unit using the thermal windows in accordance with the present invention.

FIG. 7 is an alternate embodiment of a unit stacking arrangement used with the thermal windows in accordance with the present invention. In this embodiment a pair of frame members 166 and 168 identical to those used to form frame member 12 are arranged in piggyback fashion and are substituted for the transition element 156 in FIG. 6. A continuous sponge neoprene seal 170 is provided with a pair of flanges 172 and 174 which interlock with frame member 166. Frame member 166 is then located and secured within frame 12 in any known manner. Frame member 168 is placed in abutting relationship with seal 170 within frame 12 and secured thereto. If desired, a stiffener member 176 in the form of an extruded aluminum channel may be secured by screws 178 and 180 to the back of frame members 166 and 168 so as to add additional strength. A cover 182 snaps over stiffener 176 so as to give a neat appearance.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An improved thermally broken window construction wherein said window is thermally broken without the need of an insulating material comprising:

a stationary frame member defining a window opening;

at least one face member;

said face member being provided with means for securing a window pane within said frame member;

said frame member being provided with a substantially flat base portion, a first leg portion extending from said base portion toward said window pane and substantially perpendicular to said base portion and having a free end and a second leg portion extending from said base portion in the same direction as said first leg portion and having a free end;

said first leg portion and said second leg portion each being provided with nib means extending substantially parallel to said base portion which define with said base portion first and second opposing grooves; and said stationary frame member is provided with sealing means in direct sealing engagement with one side of said window pane such that said stationary frame member is thermally broken from said securing means without the need of a thermal insulating material.

2. A window according to claim 1 wherein said tubular vent comprises a front sight wall member, an outer side wall member, an inner side wall member and a back wall member, said inner side wall member being provided with an extension, said extension being adapted to receive glazing for sealingly engaging said window pane on said other side thereof.

3. A window according to claim 1 wherein said face member of said fixed type window comprises a front sight wall member, an outer side wall member and an inner side wall member, said inner side wall member being provided with a channel adapted to receive sealing means.

4. A window according to claim 3 wherein said tubular vent comprises a front sight wall member, an outer side wall member, an inner side wall member and a back wall member, said inner side wall member being provided with an extension, said extension being provided with a flange member adapted to receive on one side thereof glazing for sealingly engaging said window pane on said other side thereof.

5. A window according to claim 3 wherein said face member is provided with a projection intermediate said inner side wall member and said outer side wall member adapted to receive said securing means.

6. A window according to claim 1 wherein said first leg portion is longer than said second leg portion and said first leg is provided at the free end thereof with means adapted to receive sealing means for sealingly engaging said window pane on said one side thereof.

7. A window according to claim 6 wherein said second leg portion is provided at the free end thereof with a pair of flanges which define therewith a channel adapted to receive sealing means for sealingly engaging said face member.

8. A window according to claim 1 wherein said face member comprises a tubular vent, said tubular vent being movable with respect to said frame member.

9. A window according to claim 8 wherein said tubular vent comprising a front sight wall member, an outer side wall member, an inner side wall member and a back wall member, said inner side wall member being provided with an extension, said extension being provided with a flange adapted to receive on one side thereof glazing for sealingly engaging said window pane on the other side thereof, said flange member being provided on the opposite side thereof with a first groove adapted to receive said securing means.

10. A window according to claim 9 wherein said back wall member is provided with a second groove adapted to receive securing means.

11. A window according to claim 10 wherein said securing means comprises a substantially U-shaped member being provided with a base, a first leg and a second leg, said first leg being provided with a first and second rounded projection adapted to be received in said first and second grooves.

12. A window according to claim 11 wherein said second leg is provided with channel means to receive glazing seal means for sealingly engaging said window pane on one side thereof.

13. A window according to claim 1 wherein said face member is provided with means for sealingly engaging said window pane on said other side thereof.

14. A window according to claim 11 wherein said face member is fixed with respect to said frame member.

15. A window according to claim 13 wherein said face member comprises a front sight wall member, an outer side wall member and an inner side wall member, said inner side wall member being provided with means for receiving said sealing means and said face member is further provided with a projection intermediate said inner side wall member and said outer side wall member adapted to receive said securing means.

16. A window according to claim 15 wherein said securing means comprises a spring, said spring being provided with first, second and third flanges adapted to mate with said first and said second opposing grooves and said projection respectively.

17. A window according to claim 16 wherein said projection is provided with a nib which defines therewith a crevice which receives said third flange.

18. A window according to claim 16 wherein said spring comprises a U-shaped portion and a tengential extension projecting from the base of said U-shaped portion, said first and second flanges being provided on said U-shaped portion and said third flange being provided on said tangential extension.

19. A window according to claim 1 wherein said frame member is adapted to interchangeably receive both fixed and operating type windows in stacked relationship each of said windows being provided with a separate face member.

20. A window according to claim 19 wherein said face member of said operating type window comprises a tubular vent, said tubular vent being movable with respect to said frame member.

21. A window according to claim 20 wherein said tubular vent comprising a front sight wall member, an outer side wall member, an inner side wall member and a back wall member, said inner side wall member being provided with an extension, said extension being provided with a flange adapted to receive on one side thereof glazing for sealingly engaging said window pane on the other side thereof, said flange member being provided on the opposite side thereof with a first groove adapted to receive said securing means.

22. A window according to claim 21 wherein said back wall member is provided with a second groove adapted to receive securing means.

23. A window according to claim 22 wherein said securing means comprises a substantially U-shaped member being provided with a base, a first leg and a second leg, said first leg being provided with a first and second rounded projection adapted to be received in said first and second grooves.

24. A window according to claim 23 wherein said second leg is provided with channel means to receive glazing seal means for sealingly engaging said window pane on one side thereof.

25. A window according to claim 19 wherein said face member of said fixed type window comprises a front sight wall member, an outer side wall member and an inner side wall member, said inner side wall member being provided with means for receiving said sealing means and said face member is further provided with a projection intermediate said inner side wall member and said outer side wall member adapted to receive said securing means.

26. A window according to claim 25 wherein said securing means comprises a spring, said spring being provided with first, second and third flanges adapted to mate with said first and said second opposing grooves and said projection respectively.

27. A window according to claim 26 wherein said projection is provided with a nib which defines therewith a crevice which receives said third flange.

28. A window according to claim 26 wherein said spring comprises a U-shaped portion and a tangential extension projecting from the base of said U-shaped portion, said first and said second flanges being provided on said U-shaped portion and said third flange being provided on said tangential extension.

29. An improved thermally broken window construction wherein said window is thermally broken without the need of an insulating material comprising:

a stationary frame member defining a window opening;

a movable tubular vent member;

a glass holding member secured to said tubular vent member so as to secure a window pane within said frame member wherein one side of said window pane sealingly engages said frame member;

said tubular vent member comprises a front sight wall member, an outer side wall member, an inner side wall member and a back wall member, said inner side wall member being provided with an extension, said extension being provided with means on one side thereof for sealing the other side of said window pane and with further means on the other adapted to receive said glass holding member.

30. A window according to claim 29 wherein said back wall means is provided with means adapted to receive said glass holding member.

31. A window according to claim 30 wherein both of said means adapted to receive said glass holding means comprises first and second grooves.

32. A window according to claim 31 wherein said glass holding means comprises a substantially U-shaped member being provided with a base, a first leg and a second leg, said first leg being provided with a first and second rounded projection adapted to be received in said first and second grooves.

33. A window according to claim 32 wherein said second leg is provided with channel means to receive glazing seal means for sealingly engaging said window pane on the other side thereof.

34. A window according to claim 33 wherein said tubular vent comprises a front sight wall member, an outer side wall member, an inner side wall member and a back wall member, said inner side wall member being provided with an extension.

35. A window according to claim 34 wherein said first groove is adapted to receive said glass holding means.

36. A window according to claim 35 wherein said frame member is provided with a base portion, a first leg portion extending from said base portion and having a free end and a second leg portion extending from said base portion and having a free end, and said first leg portion and said second leg portion each being provided with nib means which define with said base portion first and second opposing grooves.

37. An improved frame member for use with both fixed and operating type thermally broken windows wherein said windows are thermally broken without the need of an insulating material comprising:

a substantially L-shaped member being provided with a substantially flat base portion, a first leg portion extending from said base portion toward said window pane and substantially perpendicular to said base portion and having a free end and a second leg portion extending from said base portion in the same direction as said first leg portion and having a free end; and wherein said first leg portion is longer than said second leg portion and wherein each of said leg portions are provided with nib means which define with said base portion first and second opposing grooves.

38. A frame according to claim 37 wherein said first leg portion is provided at the free end thereof with a pair of flanges which define therewith a channel adapted to receive sealing means for sealingly engaging a window pane on one side thereof.

39. A frame according to claim 38 wherein said second leg portion is provided at the free end thereof with a pair of flanges which define therewith a channel adapted to receive sealing means for sealingly engaging a face member.

40. An improved thermally broken window construction wherein said window is thermally broken without the need of an insulating material comprising:

a stationary frame member defining a window opening;

a fixed face member;

said stationary frame member being provided with a pair of opposed grooves;

said fixed face member being provided with at least one groove;

spring means being provided with first, second and third flanges adapted to mate with said grooves in said frame and said face members so as to secure a window pane within said frame member; and said stationary frame member is provided with sealing means in direct sealing engagement with one side of said window pane.

41. A window according to claim 40 wherein said face member comprises a front sight wall member, an outer side wall member and an inner side wall member, said inner side wall member being provided with a channel adapted to receive sealing means for sealing the other side of said window pane.

42. A window according to claim 41 wherein said face member is provided with a projection intermediate said inner side wall member and said outer side wall member adapted to receive said spring means.

43. A window according to claim 42 wherein said projection is provided with a nib which defines therewith a groove which receives said third flange.

44. A window according to claim 40 wherein said spring comprises a U-shaped portion and a tangential extension projecting from the base of said U-shaped portion, said first and said second flanges being provided on said U-shaped portion and said third flange being provided on said tangential extension.

45. A window according to claim 44 wherein said frame member is provided with a base portion, a first leg portion extending from said base portion and having a free end and a second leg portion extending from said base portion and having a free end, and said first leg portion and said second leg portion each being provided with nib means which define with said base portion first and second opposing grooves.

* * * * *

UNITED STATES PATENT AND TRADEMARK OFFICE

CERTIFICATE OF CORRECTION

PATENT NO. : 4,187,657

DATED : February 12, 1980

INVENTOR(S) : RONALD D. SUKOLICS

It is certified that error appears in the above-identified patent and that said Letters Patent are hereby corrected as shown below:

In Column 7, claim 3, line 55, change "1" to --20--.

In Column 8, claim 14, line 45, change "11" to --13--.

In Column 8, claim 18, line 64, change "tengential" to read --tangential--.

Signed and Sealed this

*Seventeenth* Day of *June 1980*

[SEAL]

*Attest:*

SIDNEY A. DIAMOND

*Attesting Officer*

*Commissioner of Patents and Trademarks*